US006307180B1

(12) United States Patent
Arx et al.

(10) Patent No.: US 6,307,180 B1
(45) Date of Patent: Oct. 23, 2001

(54) HEATED TOILET SEAT AND METHODS FOR MAKING SAME

(75) Inventors: Theodore Von Arx, La Crescent, MN (US); Clifford D. Tweedy, St. Charles, MO (US); John W. Schlesselman, Fountain City, WI (US); Ronald E. Papenfuss, Winona, MN (US)

(73) Assignee: Watlow Polymer Technologies, Winona, MN (US)

( * ) Notice: Subject to any disclaimer, the term of this patent is extended or adjusted under 35 U.S.C. 154(b) by 0 days.

(21) Appl. No.: 09/477,582

(22) Filed: Jan. 4, 2000

Related U.S. Application Data

(63) Continuation-in-part of application No. 09/416,731, filed on Oct. 13, 1999.

(51) Int. Cl.[7] ..... H05B 1/00; H05B 3/06
(52) U.S. Cl. ..... 219/217; 219/536
(58) Field of Search ..... 219/217, 200, 219/529, 526, 538, 542, 545

(56) References Cited

U.S. PATENT DOCUMENTS

| | | | | |
|---|---|---|---|---|
| 1,058,270 | * | 4/1913 | Stephens | 219/217 |
| 2,202,095 | * | 5/1940 | Delhave et al. | 219/217 |
| 2,593,087 | * | 4/1952 | Baggett | 219/217 |
| 4,245,149 | * | 1/1981 | Fairlie | 219/528 |
| 5,111,025 | * | 5/1992 | Barma et al. | 219/217 |
| 5,940,895 | * | 8/1999 | Wilson et al. | 4/237 |
| 6,147,332 | * | 11/2000 | Holmberg et al. | 219/526 |

* cited by examiner

*Primary Examiner*—Teresa Walberg
*Assistant Examiner*—Thor Campbell
(74) *Attorney, Agent, or Firm*—Duane, Morris & Heckscher LLP

(57) ABSTRACT

A toilet seat comprises a resistive wire sewn to a support material such as a fibrous mat. The wire is preferably sewn in an annular pattern or a sinuated pattern disposed throughout the seat. The heating element can be contained within a toilet seat core, which can have a shell molded thereon to form a toilet seat.

21 Claims, 8 Drawing Sheets

HEATED TOILET SEAT AND METHODS FOR MAKING SAME

RELATED APPLICATION

This application is a continuation-in-part of U.S. patent application Ser. No. 09/416,731, filed Oct. 13, 1999.

FIELD OF THE INVENTION

The present invention relates to finish plumbing accessories generally, and more specifically, to a seat for a toilet.

DESCRIPTION OF THE RELATED ART

Several attempts have been made to develop a heated toilet seat that would gain commercial acceptance.

U.S. Pat. No. 3,968,344 describes a toilet seat heated by a resilient cover having a heating element, the cover arranged to be detachably secured to the toilet seat.

U.S. Pat. No. 4,446,584 describes apparatus for accommodating an electrical cord in a heated toilet seat. The seat has a toilet seat body and a base cover pivotally connected to each other. An electrical cord is adapted for electrical connection of a heater mounted within the toilet seat body. A controller is secured at one end by a grommet provided on the base cover and at the other end by a cord fastener in the toilet seat body. Sufficient cord slack is provided in the toilet seat body so that the cord may be retracted or extended during the pivoting of the toilet seat body.

U.S. Pat. No. 5,119,517 describes a toilet seat that is pre-heated before use by a blower.

U.S. Pat. No. 5,642,531 describes a toilet seat cover having a plurality of lights on its bottom surface. The lights warm up the seat and make it easier to find the toilet if the room is dark.

An improved heated toilet seat is desired. In particular, heated toilet seats that do not require use of a supplemental device such as lights or a blower, or removal of a heated cover before use, are desired. Toilet seats providing improved heat distribution as compared to previous heated toilet seats are also desired. The present invention is directed to these, as well as other, important ends.

SUMMARY OF THE INVENTION

One aspect of the present invention is a toilet seat having a shell and a core, wherein the core has an outer surface, the shell has a top portion and a bottom portion, and the core further includes, as a unitary body, a polymeric matrix containing therein a resistive wire sewn to a support. The resistive wire has annular portions distributed radially throughout the seat, and connecting portions routed in the radial direction connecting successive ones of the approximately annular portions.

Heated toilet seats according to the invention provide heated comfort, with heat relatively evenly distributed across the surface of the seat. Also, in preferred embodiments, by having a resistive wire embedded within a polymeric matrix having minimal or no voids therein, the heated toilet seats provide improved transfer and dissipation of heat. Moreover, preferred heating elements of the toilet seats, which comprise resistive wire sewn to a support layer, provide for improved flow of polymeric material during molding of the seat.

Another aspect of the present invention is a toilet seat having a shell and a core, wherein the core has an outer surface, the shell has a top portion and a bottom portion, and the core further includes, as a unitary body, a polymeric matrix containing therein a resistive wire sewn to a support. The resistive wire has a plurality of approximately radial portions distributed throughout the seat, and connecting portions routed in an approximately tangential direction connecting successive ones of the radial portions.

Another aspect of the present invention is toilet seat core including, as a unitary body, a polymeric matrix containing therein a resistive wire having a plurality of approximately annular portions radially distributed throughout. The resistive wire has connecting portions routed in the radial direction connecting selective ones of the approximately annular portions.

A further aspect of the present invention is a toilet seat core including, as a unitary body, a polymeric matrix containing therein a resistive wire having a plurality of approximately radial portions distributed throughout. The resistive wire has connecting portions routed in an approximately tangential direction connecting selective ones of the approximately radial portions.

Another aspect of the present invention is a method of fabricating a toilet seat, comprising forming a core by a process comprising the steps of:

(a) providing a resistive wire and a support layer;
(b) sewing the resistive wire to the support layer;
(c) adding at least one polymeric material to the support layer;
(d) molding the polymeric material to a desired shape so that the support layer having the resistive wire affixed thereto is substantially contained within the polymeric material; and
(e) forming a shell on the exterior of the core, to form a toilet seat.

A further aspect of the present invention is a method of fabricating a toilet seat, comprising:

(a) providing a resistive wire and a support layer;
(b) sewing the resistive wire to the support layer;
(c) adding at least one polymeric material to the support layer; and
(d) molding the polymeric material to a toilet seat shape so that the support layer having the resistive wire sewn thereto is substantially contained within the polymeric material.

DETAILED DESCRIPTION

The disclosures of U.S. application Ser. No. 08/767,156, filed Dec. 16, 1996; U.S. application Ser. No. 09/186,017, filed Nov. 4, 1998; U.S. application Ser. No. 09/281,622, filed Mar. 30, 1999; U.S. application Ser. No. 09/369,779, filed Aug. 6, 1999; U.S. application Ser. No. 09/416,371, filed Oct. 13, 1999; and U.S. Pat. No. 5,586,214 issued Dec. 17, 1996 are each hereby expressly incorporated by reference herein in their entireties.

FIGS. 1–6 show portions of an exemplary heated toilet seat core 100 according to the invention. The toilet seat core 100 has a radial direction $e_R$ a tangential direction $e_\theta$ and a resistive wire 103 or 123. In the embodiment shown in FIG. 5, the resistive wire 103 has a plurality of approximately annular portions 103*a*. The approximately annular portions 103*a* are disposed radially throughout the core of the seat, approximately parallel to the perimeter of the seat core. The resistive wire 103 is embedded within a polymeric matrix 105. The resistive wire 103 has connecting portions 103*r* routed approximately in the radial direction $e_R$ connecting successive ones of the annular portions 103*a*. The plurality of annular wire portions 103*a* provide uniform heating and comfort across the width of the seat core 100. In the embodiment shown in FIG. 6, resistive wire 123 has a plurality of approximately radial portions 123*r*. The approximately radial portions 123*r* are disposed throughout the core of the seat, and are connected by approximately tangential portions 123*t* which are approximately parallel to the perimeter of the seat core. The plurality of radial portions of wire provide uniform heating and comfort across the width of the seat core 100.

In comparison with conventional seat heating systems, the invention provides heat evenly, avoiding hot spots and providing for heated comfort during use. The resistive wire 103 or 123 is embedded within a polymeric matrix 105, providing maximum contact between the wire and the polymeric matrix. While it is not intended that the invention be bound by any particular theory, it is believed that the maximum contact between the wire and the polymeric matrix provides improved heat transfer as compared to other heated toilet seats that employ wires contained within voids or passages in a plastic molded part.

According to preferred embodiments of the present invention, when a resistive wire 103 having a generally annular configuration is embedded within a polymeric matrix 105, and the matrix having the wire embedded therein is used to form a toilet seat, the heat is evenly distributed over a large portion of the seat area, and it is possible to dissipate more power (for example, about 15 watts) without causing higher surface temperatures in the vicinity of the resistive wire 103 than elsewhere on the surface of the seat. A toilet seat according to the invention heats up to a desired temperature quickly.

Figure 5:
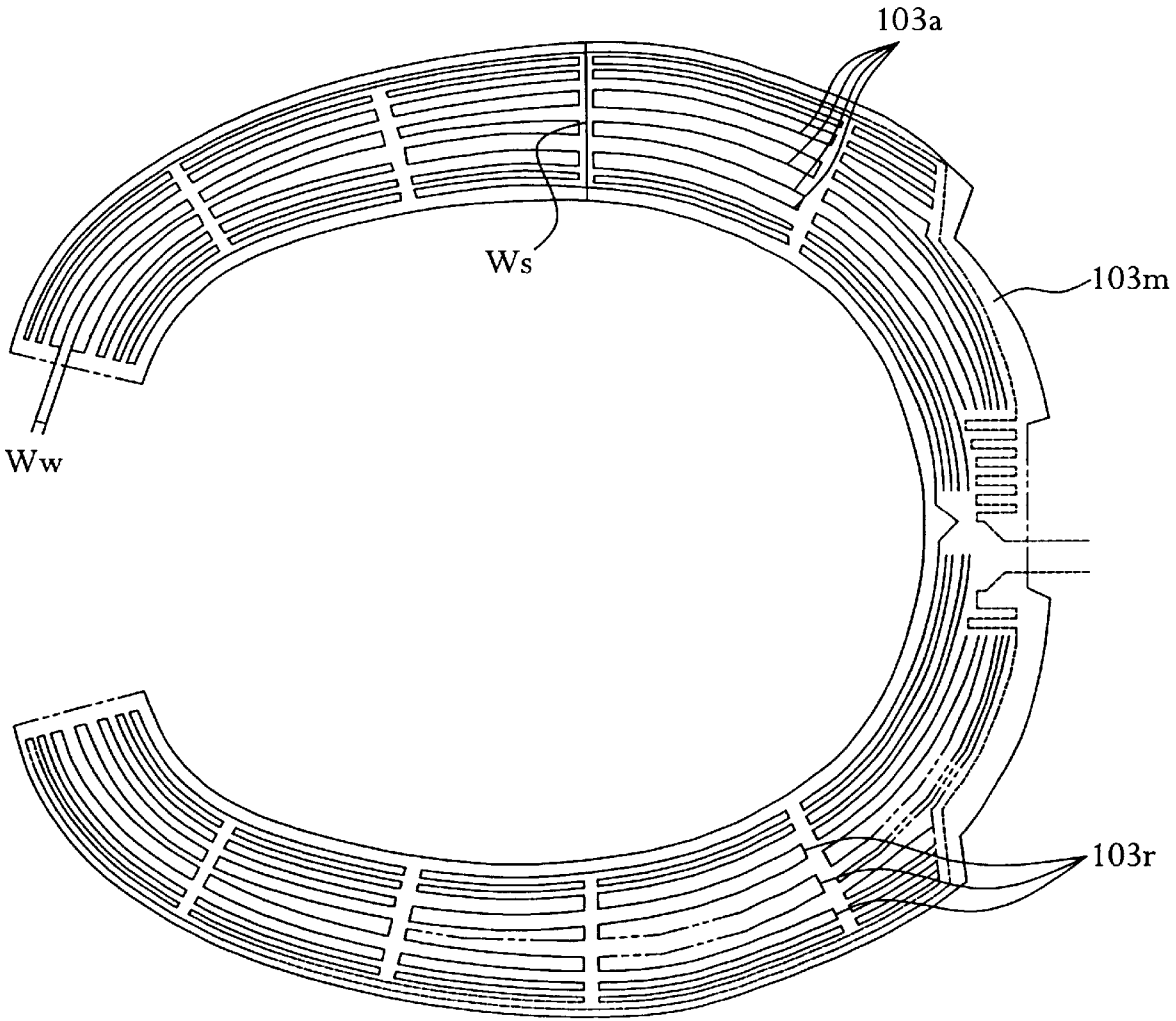
FIG. 5 is a top plan view of an annular stitching pattern for affixing resistive wire to a support for use in forming a toilet seat core portion as shown in FIG. 3.
Figure 6:
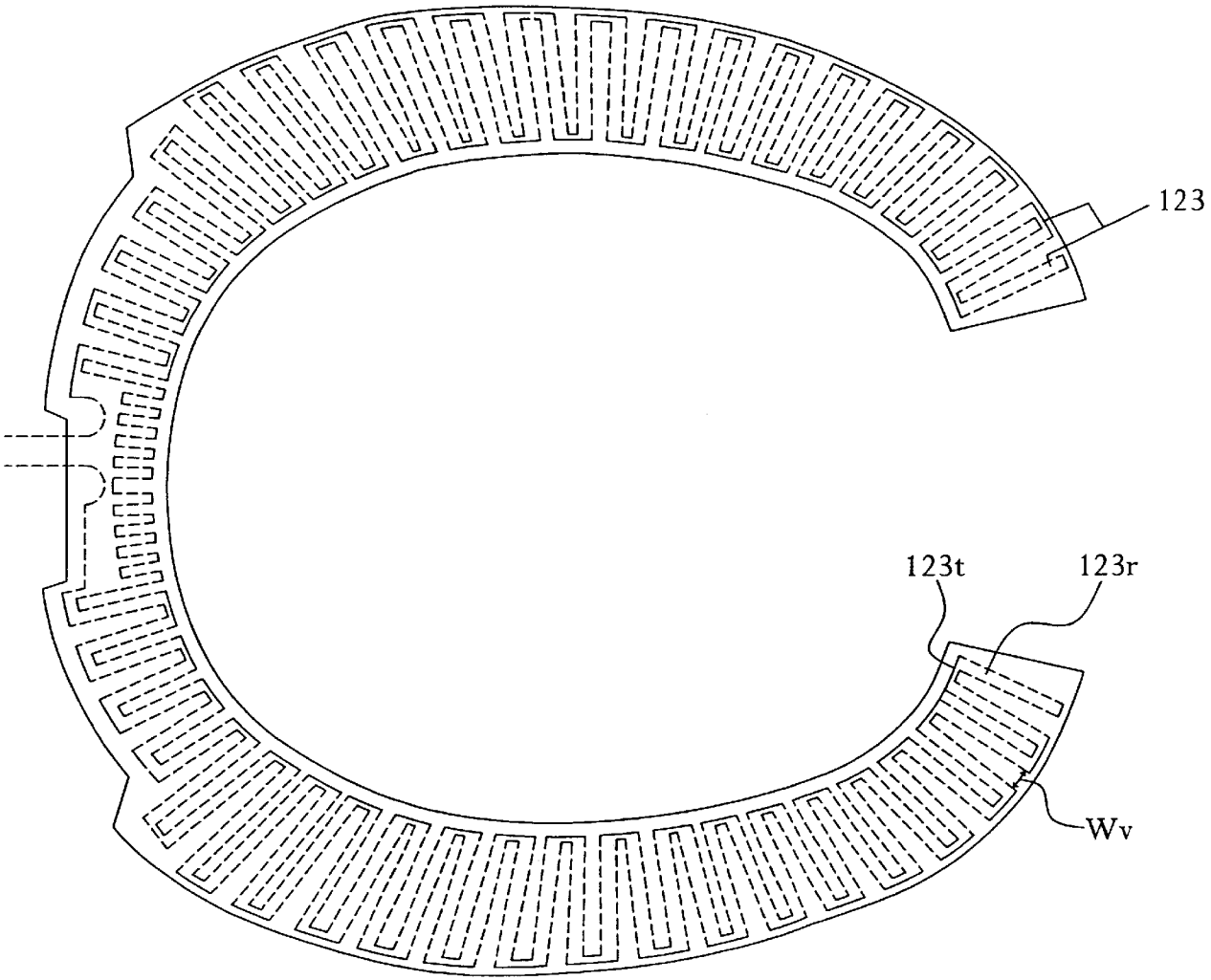
FIG. 6 is a top plan view of a sinuated stitching pattern for affixing resistive wire to a support for use in forming a toilet seat core portion as shown in FIG. 3.
Figure 7:
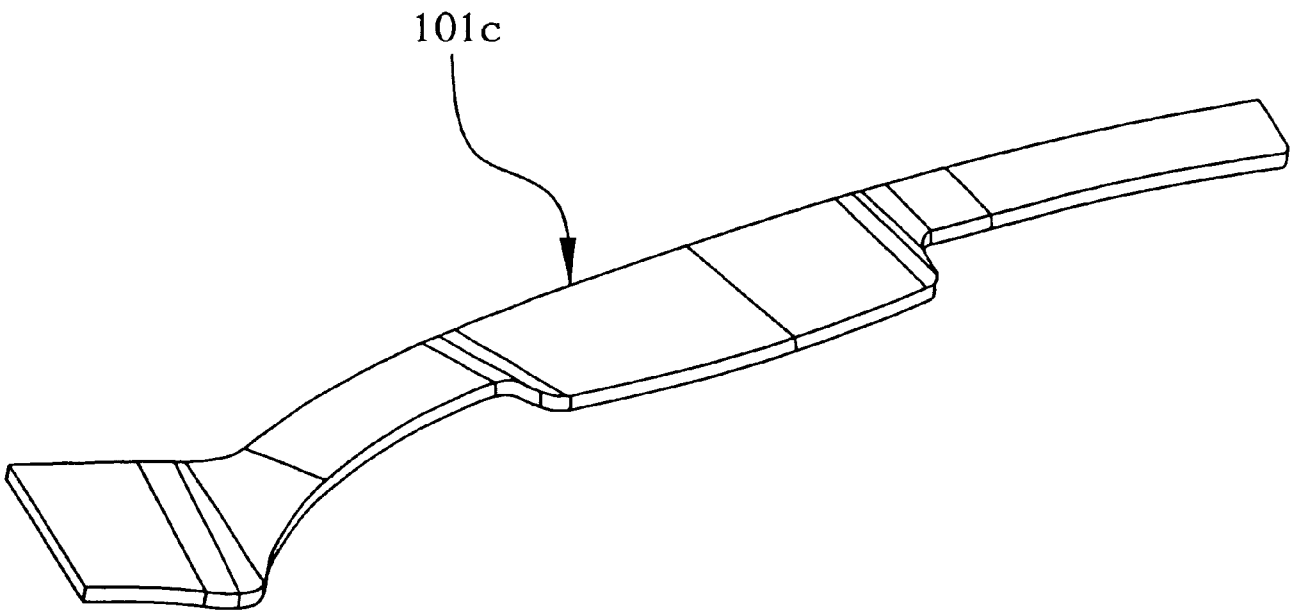
FIG. 7 is a top plan view of cover 101*c* for junction box 101 shown in FIG. 2.

As best seen in FIG. 5 and FIG. 6, the exemplary seat 100 includes a heating element in the form of a resistive wire 103 affixed to a mat of material 103*m*. The mat of material forms a support layer, and preferably includes glass fibers. Preferred heating elements for use according to the invention are described in U.S. patent application Ser. No. 09/309,429, the disclosure of which is hereby incorporated herein by reference in its entirety. As shown in FIG. 5, resistive wire 103 in annular portions 103*a* is affixed to the mat of material 103*m* during manufacture of the toilet seat 100. In FIG. 6, another embodiment is shown wherein resistive wire 123 is affixed to the mat in a sinuated pattern that includes radial portions 123*r* joined by approximately tangential portions 123*t*.

In preferred embodiments, the wire 103 is sewn to the mat 103*m*. When the wire 103 is sewn to the mat 103*m*, it is preferably sewn using a stitch pattern such as that shown in FIG. 5 or that shown in FIG. 6. In the exemplary stitch pattern in FIG. 5, a resistive wire is used to sew into a mat a pattern of multiple annular portions 103*a* connected by radial portions 103*r*. In the exemplary stitch pattern in FIG. 6, a resistive wire is used to sew into a mat a sinuated pattern including radial portions 123*r* joined by tangential portions 123*t*. While it is preferred that a continuous length of resistive wire be used to form the desired pattern, two or more segments of resistive wire can be used.

A single strand of resistive wire can be used. However, it is preferred to use a multi-strand wire formed of two or more single wires. In highly preferred embodiments, the wire has three strands, allowing for a helical configuration. A helical configuration is believed to maximize longitudinal mechanical stress relief in the wire. If a single strand is used, the diameter of the wire is preferably from about 1/16 inch to about 3/16 inch, more preferably about 1/8 inch. If multiple strands of wire are used, the diameter of each strand is preferably from about 1/30,000 inch to about 5/30,000 inch, more preferably from about 1/15,000 to about 1/10,000 inch.

The wire 103 or 123 can be affixed to a mat using other methods known to those skilled in the art, such as, for example, bonding with an adhesive. Preferred adhesives are thermally conductive, or include thermally conductive additives, such as aluminum oxide or magnesium oxide. Also preferably, adhesives for use according to the invention contain relatively low amounts of volatile organic compounds.

Figure 1:
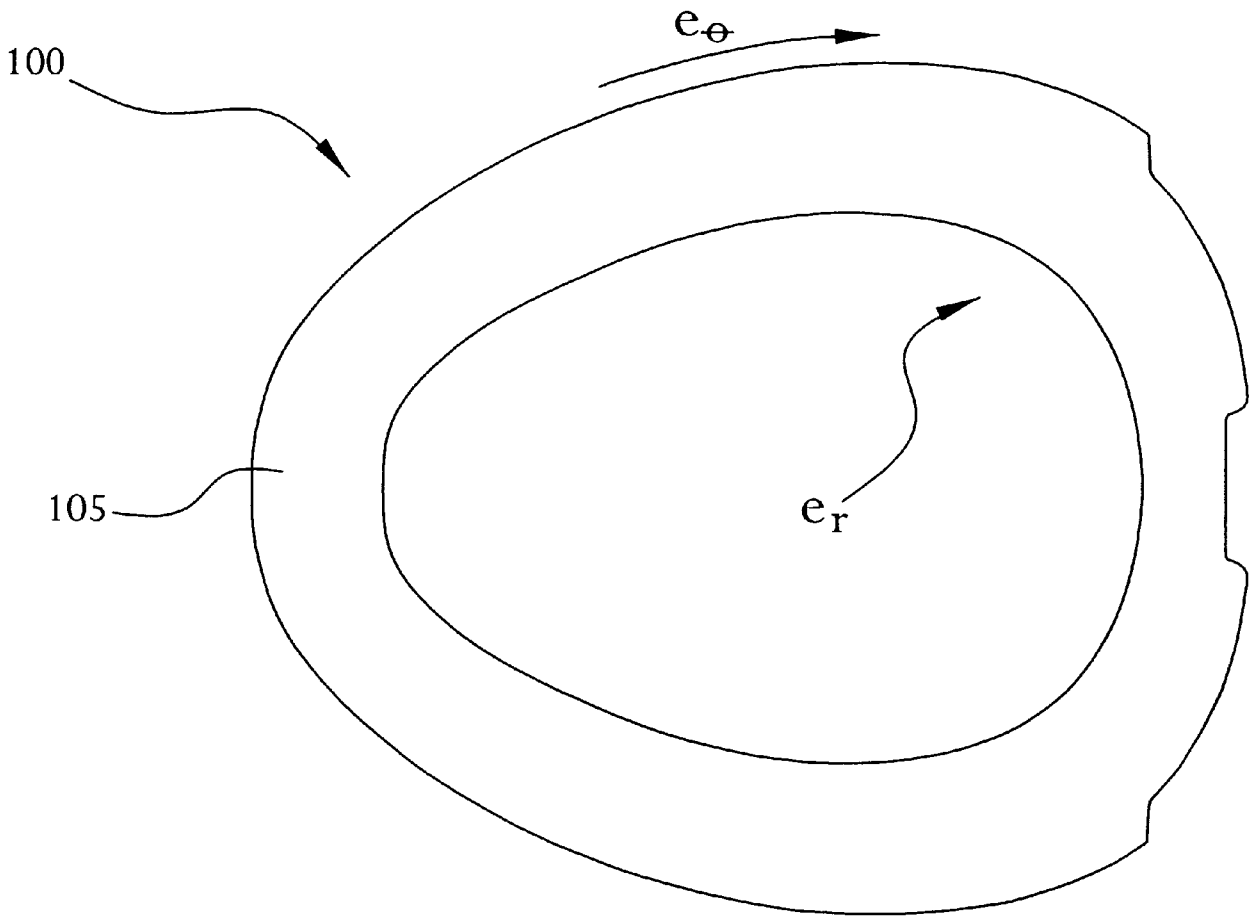
FIG. 1 is a top plan view of an exemplary heated toilet seat core according to the invention.
Figure 2:
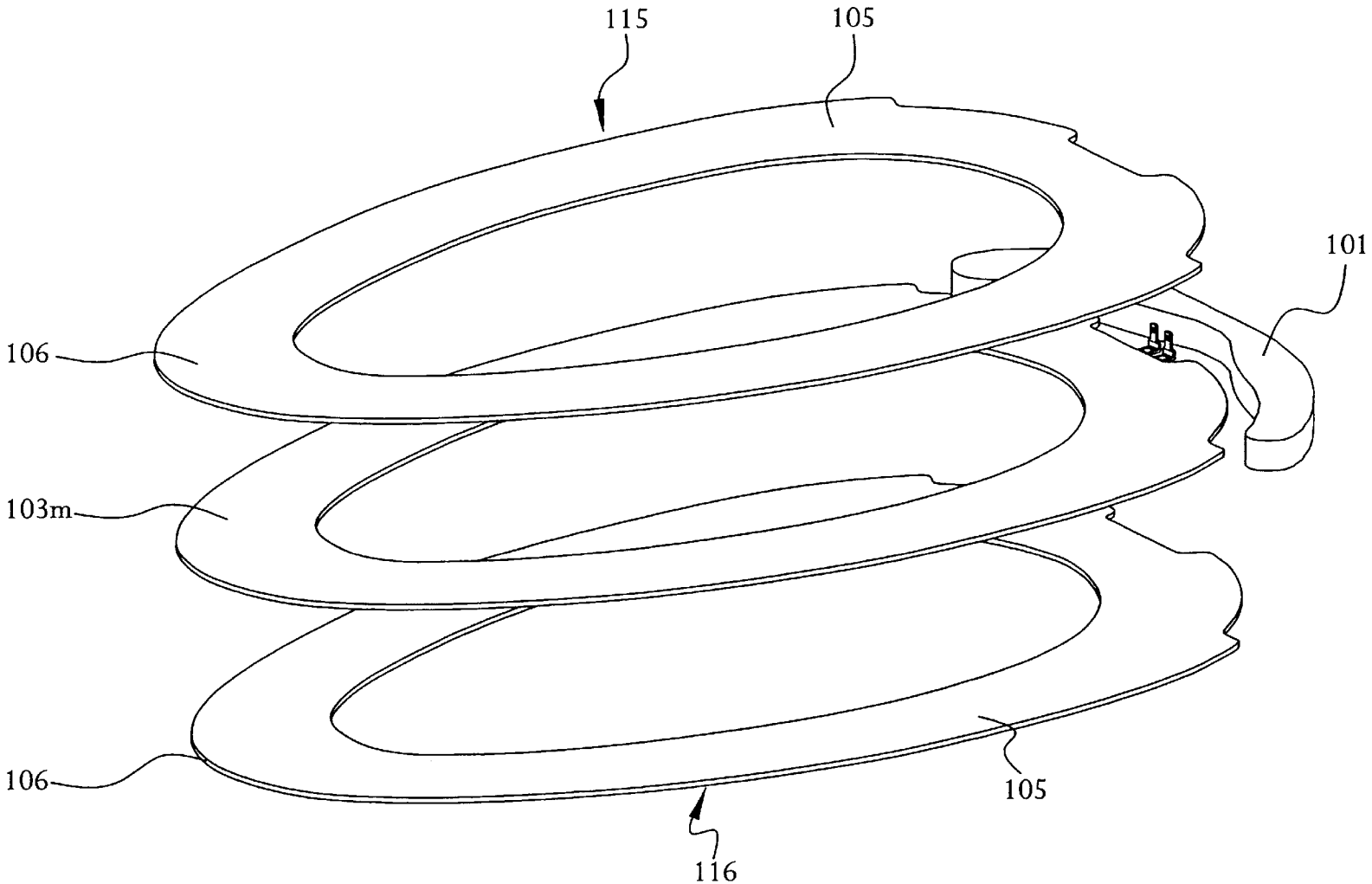
FIG. 2 is an exploded view of the toilet seat core shown in FIG. 1. The edge of the seat is omitted from FIG. 2 for easier viewing of the interior features.
Figure 3:
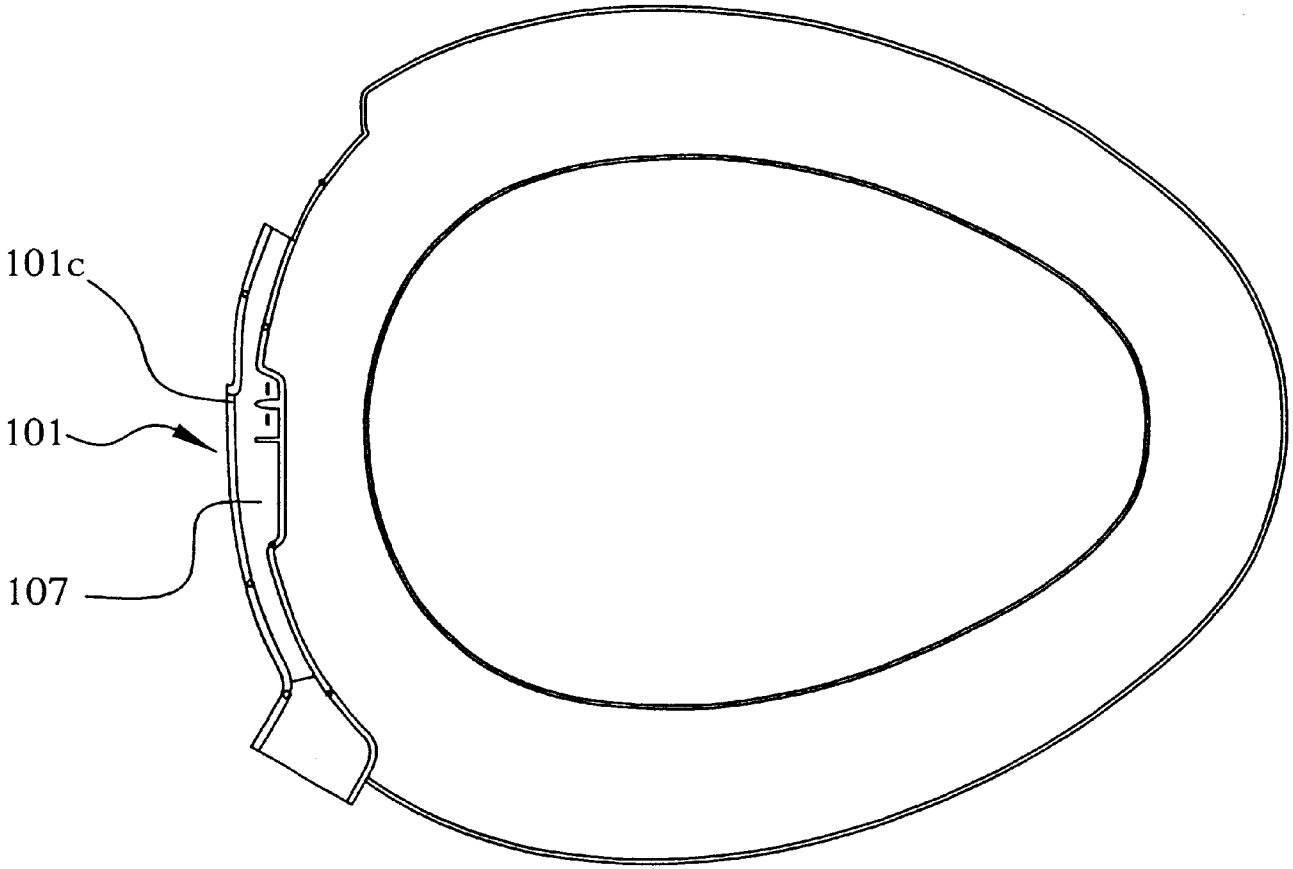
FIG. 3 is a top plan view of the interior portion of the toilet seat core shown in FIG. 1.
Figure 4:
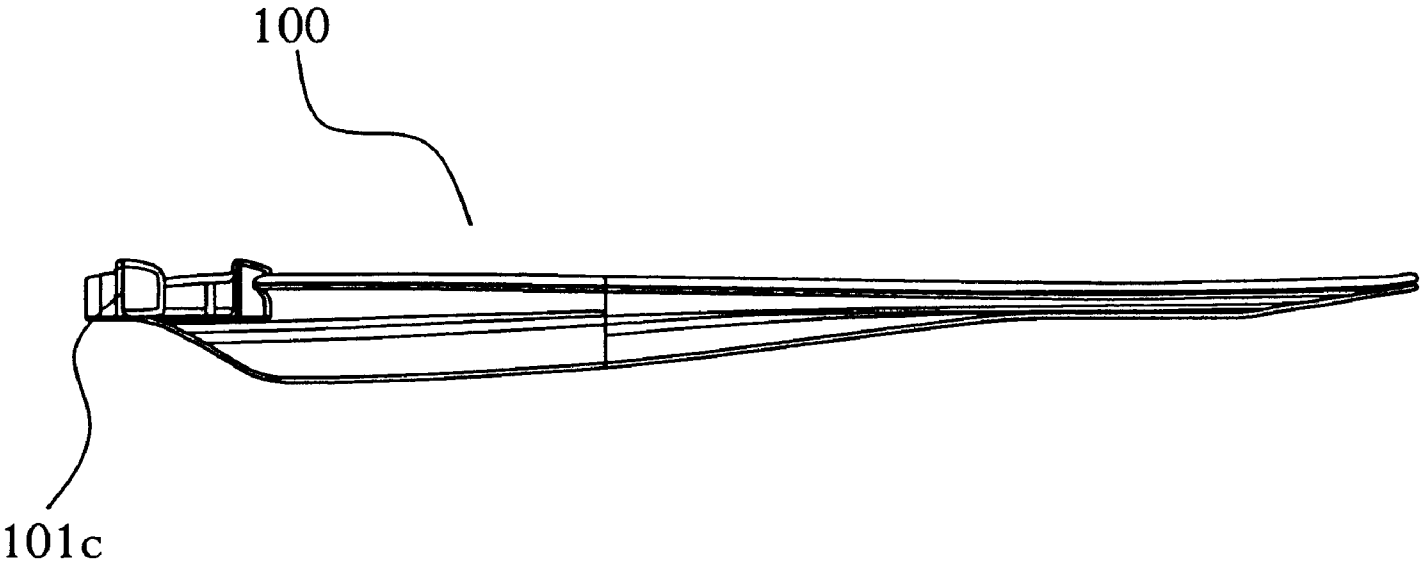
FIG. 4 is a partial cutaway side elevation view of the interior portion of the toilet seat core shown in FIG. 3. The edge of the core portion is partially cut away for easier viewing of the interior features in FIG. 4.

After the wire 103 is affixed to the mat 103*m*, the seat core 100 is formed. Formation of the seat core 100 includes molding a polymeric material to form a polymeric matrix 105 in the desired shape for a toilet seat. The polymeric material can be a thermoplastic or thermoset material, and is preferably a thermoset material. If desired, the polymeric matrix 105 may be provided in the form of a premold 106, which is then molded to the desired shape. The premold 106 can be provided in two or more sections, as shown in FIG. 2, which can then be molded together to form the desired shape. The wire thereby becomes embedded within the polymeric matrix 105, and the seat core including the wire 103 forms a unitary body. Preferably, there are substantially no voids within the unitary body.

A toilet seat can assume a variety of shapes. The shape of the seat core 100 can be chosen depending upon the desired shape of a toilet seat to be made containing the core, and may approximate a circle, an ellipse, an oval, a "C" or a "U". Often, the nominal shape is only an approximation, and the seat and core do not conform precisely to the analytic geometrical equations defining the nominal shape. Thus, it may be difficult to define a "radius", a "tangent" or the "annular" or "radial" direction. The radial direction, as used herein, is approximately perpendicular to the perimeter of the core and the seat. The annular direction, or an annular configuration, as used herein, means forming a ring approximately parallel to the perimeter of the seat The tangential direction, as used herein, is also approximately parallel to the perimeter of the seat.

For example, in the embodiment shown in FIG. 5, to provide relatively uniform spacing $W_w$ between consecutive annular portions 103*a* of wire, the annular portions of wire may vary from being parallel to the perimeter of the seat by, for example, up to about 5°. The angle of the annular portions 103*a* of wire (with respect to the perimeter) is less important than the spacing $W_w$ between the annular portions of wire. It is preferred that the spacing $W_w$ between the annular portions 103*a* of the wire be substantially uniform, for example, varying by no more than about 10%. Similarly, the approximately radial portions 103*r* of the wire 103 need not be exactly perpendicular to the perimeter of the seat 100. The spacing between successive annular portions of the resistive wire is preferably from about 0.08 inch to about 0.3 inch, more preferably from about 0.09 inch to about 0.25 inch, more preferably from about 0.1 inch to about 0.2 inch.

Referring to FIG. 5, the resistive wire 103 has an annular configuration and extends over at least about 50% of the surface area of the seat core 100, preferably at least about 70%, and more preferably, at least about 85%. By spreading the resistive wire 103 across a larger portion of the surface area of the seat core 100, heat is more evenly spread from the resistive wire 103 throughout the toilet seat core, providing more even heat distribution in a seat formed using the core. The annular portions 103*a* of the resistive wire 103 are substantially longer than the connecting portions 103*r*. The annular configuration of the wire distributes heat across the width Ws of the seat core 100 better than conventional devices (such as that shown in U.S. Pat. No. 3,968,344, which only has a tangential loop of wire located at about the center of the width of the seat). Furthermore, it has been found that the annular configuration provides for improved heat distribution to the edges of the seat. The distribution of heat to the edges can be further improved by reducing the spacing between the annular portions of the wire. For example, the annular portions of the wire can be closer together near the edges than in the remaining portions of the core.

Referring to FIG. 6, the resistive wire 123 has a sinuated configuration and extends over at least about 50% of the surface area of the seat core 100, preferably at least about 70%, and more preferably, at least about 85%. By spreading the resistive wire 123 across a larger portion of the surface area of the seat core 100, heat is more evenly spread from the resistive wire 123 throughout the toilet seat core, providing more even heat distribution in a seat formed using the core. The radial portions 123*r* of the resistive wire 123 are preferably longer than the connecting, approximately tangential, portions 123*t*. Furthermore, the radial portions of the resistive wire can vary from being parallel to one another, by, for example, up to about 5° or even 10°, in order to distribute the resistive wire throughout substantially the entire seat core 100. The spacing $W_v$ between radial portions 123*r* of wire in the embodiment shown in FIG. 6 is also preferably from about 0.08 inch to about 0.3 inch, more preferably from about 0.09 inch to about 0.25 inch, more preferably from about 0.1 inch to about 0.2 inch, determined, in part, by the ability of polymeric material to flow between the wires.

It has been found that the use of a sinuated pattern for the wire is advantageous for molding, in that it can allow for improved flow of polymeric material in a mold, thus providing better filling of a mold and improved mechanical strength, as compared to other wire patterns. Modifications of sinuated patterns, such as, for example, sinuated patterns in which the wire comprises "turns" representing a sinusoidal curve, are also useful and within the scope of the present invention. Thus, a wire sewn in a sinuated pattern can be routed in approximately rectilinear segments as shown in FIG. 6, or in curved segments, or both.

Reference numbers in the following description may be found in FIG. 5 or FIG. 6. It is to be understood that, unless otherwise indicated, the description can refer to either figure. That is, the resistive wire can be in an annular, sinuated, tangential or other configuration.

In preferred embodiments, the toilet seat core 100 contains a resistive wire 103 or 123 sewn to a mat 103*m*, also referred to as a support layer. The mat 103*m* functions in part to hold the resistive wire 103 or 123 in place while a polymeric material is applied, preferably under pressure. It is preferred that the mat 103*m* be of a material that allows the polymeric material to be added without substantially deforming the resistive wire 103, preferably a fibrous material. Preferred materials for the mat 103*m* include resilient nonconducting fibers such as fibers of glass, boron, or polymeric materials including nylon, polyethylene, and polypropylene. Non-woven cellulosic or non-cellulosic fibrous materials can also be used. More preferred are non-woven glass mats, such as those available from Johns Manville under the name "Dura-Glass™". As disclosed in U.S. patent application Ser. No. 09/309,429, already incorporated herein by reference, the resistive heating material can be bonded to the support layer with a suitable adhesive such as acrylic, epoxy, silicon, phenolic, or ester-based adhesives. Preferably, according to the invention, the heating material is affixed to the support layer by sewing. Stitching preferably includes stitching in a pattern such as that shown in FIG. 5. Sewing can be accomplished using machines such as model no. TMLG 6116 available from Tajima (Japan).

The seat core 100 is finished by molding a polymeric material, which may be thermoplastic material or a thermoset material, preferably a thermoset material, to the desired shape, thereby forming a matrix 105 incorporating the heating element. Preferred polymeric materials are those that do not deform significantly or melt at fluid medium temperatures of about 120–1800° F. Examples of preferred thermoplastic materials include polyvinyl chloride, nylons, fluorocarbons, linear polyethylene, polyurethane prepolymer, polystyrene, polypropylene, polyaryl sulfones, polyphenylene sulfides, polyether sulfones, polyimides, polyetheretherketones, and cellulosic and acrylic resins, as well as mixtures and copolymers thereof Examples of preferred thermoset materials include crosslinked polyethylene, phenolics, alkyds, amino resins, polyesters, epoxides, silicones and crosslinked rubber. Thermosetting polymers are highly preferred, although thermoplastic polymers preferably having a melting temperature greater than about 200° F. can be used. Liquid-crystal polymers or polymer blends can also be employed for improving high temperature chemical processing. For example, small amounts of liquid-crystal polymer or polyphenylene sulfide particles can be added to a less expensive base polymer such as epoxy or polyvinyl chloride, to improve thermal conductivity. In preferred embodiments of this invention, thermoset polyester may be used because of its/their favorable elevated temperature service, cost and processability, especially during compression molding.

If desired, polymers used in making the seat and/or the seat core can contain up to about 5–40 wt. % percent fiber reinforcement, such as graphite, glass or polyamide fiber. The polymers may also include various additives known to those skilled in the art for improving thermal conductivity and mold-release properties. Thermal conductivity can be improved, for example, by the addition of ceramic materials such as MgO and $A1_2O_3$, carbon, graphite or metal powder or flakes. It is important, however, that such additives are not used in excess, because an overabundance of any conductive material may impair the electrical insulation and corrosion-resistance effects of the preferred polymers. Any of the polymeric elements of a toilet seat core or toilet seat according to the invention can be made with any combination of the exemplary polymeric materials and optional additives, or selective ones of the polymers can be used with or without additives for various parts of this invention depending on the end use for the element.

A number of alternative wire winding configurations may be used in forming the heating element. One of ordinary skill in the art recognizes that additional windings increase the length of the wire; to maintain the same total resistance (and heat dissipation) the cross sectional area of the wire 103 could be increased, or a material having a lower resistivity could be used. An exemplary resistive wire 103 may include two strands 42 gage alloy 675 (Res C) MACPAC No. 326-042-001 and one strand 42 gage alloy 650 (RES A) MACPAC No. 323-042-001. Such exemplary wiring has a total resistance between about 900 ohms and about 1250 ohms. Preferably, the wire has a total resistance from about 1100 to about 1250 ohms. The resistive wire preferably has a resistivity between about from 16 to 40 ohms per meter, and more preferably from about 9 to about 12 ohms/meter. Exemplary values for the resistivity include 9.7 ohms/meter and 11.9 ohms/meter. A tolerance of about +/−3 ohms is preferred, i.e. it is preferred that the resistivity of the wire be within 3 ohms of the values recited herein.

Figure 8:
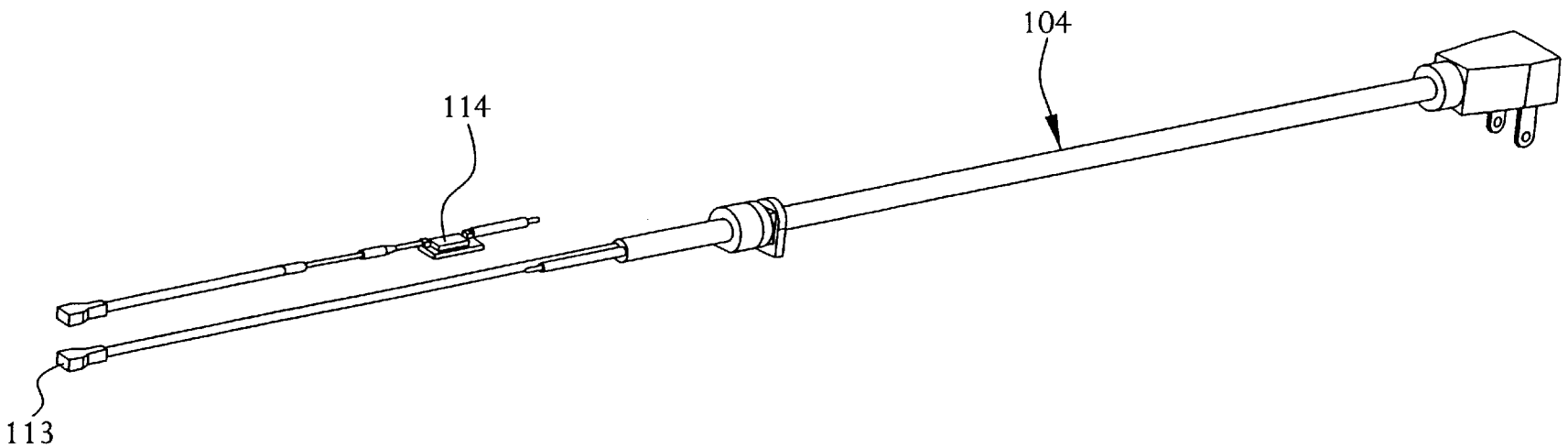
FIG. 8 is an isometric view of a power cord used to provide power to the resistive wire 103*r* or 123*r*.

Once the seat core 100 is molded, embedding the resistive wire 103 or 123 therein, a power cord 104, as shown in FIG. 8, can be connected to the resistive wire 103 via a terminal 113. The cord 104 may optionally have a switch therein (not shown), or a separate switch may be included on the seat 100. In the example shown in FIG. 3, there is a cavity 107, forming a junction box 101 within the toilet seat 100. A power cord 104 is connected to the resistive wire 103 within the junction box 101. The thermoplastic material near each end of the resistive wire can be melted, so that the thermoplastic material secures the resistive wire upon resolidification, thereby providing stress relief. A thermostat 114 is housed within the junction box 101, protected by cover 101*c*. The thermostat is connected to the power cord 104.

In installing a power cord, strain relief for the cord should be provided and a means for holding the cord in place within the junction box should be included. It is preferred that such means exert minimal pressure on the cord so that the conducting wires within the cord are not compressed or distorted.

The molded toilet seat core 100 has a top surface 115 and a bottom surface 116. For convenience, the top surface 115 can be described as comprising approximately the upper half of the outer surface of the seat when the seat is positioned as for use, and the bottom surface 116 can be described as comprising approximately the bottom half of the outer surface of the seat.

In some embodiments, the molded toilet seat core 100 can be molded to the final desired shape of a toilet seat, thus forming not only the core but the finished toilet seat. In preferred embodiments, the molded toilet seat core 100 is contained within an enclosure, also referred to as a "shell". In such embodiments, the combination of core and shell can be referred to as a "toilet seat assembly". The shell is preferably made of a polymeric material, and can be a thermoplastic material or a thermoset material, including those thermoplastic and thermoset materials recited hereinabove. The shell preferably has a shape that conforms to the shape of the molded toilet seat core 100 as provided according to the invention. However, also preferably, the shell is provided in two portions, a top portion and a bottom portion. The top portion of the shell preferably has a shape that conforms to the shape of the top surface of the core, and the bottom portion of the shell has a shape that conforms to the shape of the bottom surface of the core. Also preferably, the top portion of the shell, although generally conforming in shape to the core, is sized and shaped so that there is a void of about ¼ to ¾ inch, more preferably about ½ to about ⅜ inch, between the outer surface of the molded toilet seat core and the top portion of the shell. It is believed that the presence of a void contributes to the uniformity of heating of a toilet seat made using the core.

The top and bottom portions of the shell may by attached to each other by any conventional technique, such as, for example welding, thermal fusion, or the use of adhesives or fasteners. Thermoplastic materials may be joined by ultrasonic welding.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A toilet seat comprising a shell and a core, said core comprising an outer surface, said shell comprising a top portion and a bottom portion, and said core further comprising, as a unitary body, a polymeric matrix containing therein a resistive wire sewn to a support.

2. The toilet seat of claim 1, wherein said resistive wire comprises a plurality of approximately annular portions radially distributed throughout the seat, and connecting portions routed in the radial direction connecting selective ones of the approximately annular portions.

3. The toilet seat of claim 1, wherein said resistive wire comprises a plurality of approximately radial portions distributed throughout the seat, and connecting portions routed in an approximately tangential direction connecting selective ones of the approximately radial portions.

4. The toilet seat of claim 1, wherein said resistive wire is sewn in a sinuated pattern.

5. The toilet seat of claim 1, further comprising a void of about ¼ to ¾ inch between the outer surface of the core and the top portion of the shell.

6. The toilet seat of claim 1, having a cavity therein, said cavity forming a junction box within the toilet seat.

7. The toilet seat of claim 6, further comprising a power cord connected to the resistive wire, the connection being within the junction box.

8. The toilet seat of claim 7, further comprising a thermostat within the junction box, the thermostat being connected to the power cord.

9. The toilet seat of claim 1, wherein said support comprises a mat comprising glass fibers.

10. The toilet seat of claim 1, wherein said wire is a continuous wire.

11. The toilet seat of claim 1, wherein said wire is a multi-strand wire.

12. The toilet seat of claim 1, wherein said polymeric material comprises a thermoplastic material.

13. The toilet seat of claim 12, wherein said thermoplastic material is selected from the group consisting of polyvinyl chloride, nylons, fluorocarbons, linear polyethylene, polyurethane prepolymer, polystyrene, polypropylene, polyaryl sulfones, polyphenylene sulfides, polyether sulfones, polyimides, polyetheretherketones, and cellulosic and acrylic resins, as well as mixtures and copolymers thereof.

14. The toilet seat of claim 1, wherein said polymeric material comprises a thermoset material.

15. The toilet seat of claim 14, wherein said thermoset material is selected from the group consisting of crosslinked polyethylene, phenolics, allyds, amino resins, polyesters, epoxides, silicones and crosslinked rubber.

16. The toilet seat of claim 1, wherein the resistive wire has a total resistance between about 900 ohms and about 1250 ohms.

17. The toilet seat of claim 1, wherein the resistive wire has a resistivity between about 16 ohms/meter and about 40 ohms/meter.

18. The toilet seat of claim 2, wherein the spacing between successive annular portions of said resistive wire is from about 0.08 inch to about 0.3 inch.

19. The toilet seat of claim 3, wherein the spacing between successive radial portions of said resistive wire is from about 0.08 inch to about 0.3 inch.

20. The toilet seat of claim 2, wherein said approximately annular portions of the resistive wire are substantially longer than the connecting portions.

21. The toilet seat of claim 3, wherein said approximately radial portions of the resistive wire are substantially longer than the connecting portions.

* * * * *